United States Patent [19]

Christensson

[11] Patent Number: 4,883,193

[45] Date of Patent: Nov. 28, 1989

[54] POWDER PROOF RECLOSABLE LID FOR CONTAINERS

[75] Inventor: Lars Christensson, Gliavägen, Sweden

[73] Assignee: Akerlund & Rausing Licens AB, Jarfalla, Sweden

[21] Appl. No.: 246,442

[22] Filed: Sep. 19, 1988

[30] Foreign Application Priority Data

Oct. 14, 1987 [SE] Sweden ..... 8703994

[51] Int. Cl.[4] ..... B65D 41/32

[52] U.S. Cl. ..... 220/266; 220/339

[58] Field of Search ..... 206/807; 220/265, 266, 220/268, 270, 339

[56] References Cited

U.S. PATENT DOCUMENTS

| | | | |
|---|---|---|---|
| 3,494,458 | 2/1970 | Meierhoefer | 220/265 X |
| 4,361,250 | 11/1982 | Foster | 220/266 |
| 4,610,371 | 9/1986 | KarKiewicz | 220/266 |
| 4,658,955 | 4/1987 | Eichner | 206/807 X |
| 4,658,980 | 4/1987 | Lindstrom | 220/339 X |
| 4,711,363 | 12/1987 | Marino | 220/266 |

FOREIGN PATENT DOCUMENTS

| | | | |
|---|---|---|---|
| 2081228 | 2/1982 | United Kingdom | 220/265 |

*Primary Examiner*—Jimmy G. Foster
*Assistant Examiner*—Nova Stucker

[57] ABSTRACT

A reclosable lid has a frame (1) adapted to be sealingly secured to a container tube or sleeve (9), a sealing lid (2) which is rotatable connected to the frame (1) by one or more hinges (3), and a tamper proof device comprising a securing pin (11) cooperatively mounted between the lid (2) and the frame (1) for locking engagement with the frame such that the lid (2) can only be released from the frame (1) by breaking one or more locking connections (13, 14). The securing pin (11) is connected to the lid by means of a connection (13, 14) which can be broken off and extends through a bore (15) of the frame and engages, with a locking part (12) thereof, under an edge of the lid frame (1). The securing pin (11) is prevented from moving out of locking engagement with the lid frame (1) when the lid frame only (1) is connected to a container tube (9) whereby the lid (2) is released from the frame by breaking off the securing connection (13, 14) while leaving the securing pin (11) in the frame (1).

3 Claims, 2 Drawing Sheets

POWDER PROOF RECLOSABLE LID FOR CONTAINERS

Figure 1:
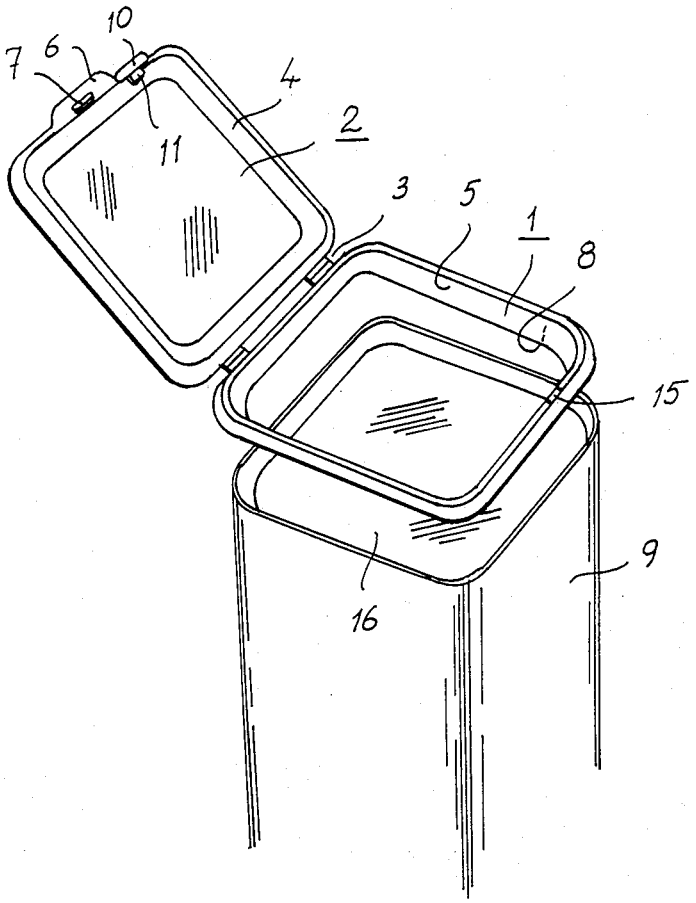

The present invention generally relates to a reclosable lid for containers, in particular containers made of cardboard, a cardboard laminate, plastic etc., and adapted for goods intended to be portioned out step by step, and in which the container is designed so that it can be reclosed under powder proof or preferably steam proof conditions, after having been opened for the first time, in order to protect the packed goods against loss of aroma, oxidization, entering of moisture etc.

A special demand on the actual reclosable lid is that is should also be tamper proof, so that a customer can verify that the container has never been opened. This is an important demand on many types of containers, for instance containers having a reclosable lid, in which a portioning spoon or a similar means is enclosed between the reclosable lid and some part of the container.

Many different types of reclosable lids of this type are known, for instance from the Europen patent publication nr. 72.294, which comprise a frame against which a container sleeve is adapted to be secured, and a lid which is hinge connected to said frame. The tamper proof means in said type of reclosable lids is formed as a pin, or a couple of pins, projecting up from the lid frame and extending through corresponding bores of the lid part, and which are upset or weld secured on top of the lid part. The container is opened in that the pins upset at the upper surface of the lid are broken off, whereby the lid can be folded up from the lid frame.

A tamper proof means of the described type is disadvantageous in some respects. For manufacturing reasons the reclosable lid, which is generally made of plastic, is manufactured in its folded up or open condition with the lid and the lid frame substantially in a common plane. The reclosable lid is then delivered to the customer who is generally the one who makes and/or fills the actual container, whereby the lid frame of the reclosable attached to a container sleeve, which is generally filled from the bottom, and is sealed. The reclosable lid known from the above mentioned European patent publication has to be folded down or closed with the lid pressed down over the lid frame in connection with the manufacture thereof, so that the tamper proof means can be secured by means of welding or any other operaion. This procedure involves several additional operation steps, and the closed lid normally is more voluminous than the folded open lid. In case the lid frame has a complete bottom surface and a portioning spoon or a similar means is to be placed between the frame bottom and the reclosable lid this has to be done before the lid is folded down closed and the tamper proof means is secured. In this case the customer can not check that the correct spoon has been provided and also can not change the type of spoon for different goods.

The invention therefore is intended to solve the problem of providing a powder proof reclosable lid means having a frame to which a container tube or sleeve can be secured, and a sealing lid which is hinge connected to said frame, and in which the sealing and the frame are formed with cooperating means for providing a tamper proof structure and designed so that the lid can be opened and closed in relation to the frame until the frame has assembled with over the container tube or sleeve and has been secured thereto, and in which the reclosable lid including the tamper proof means can be manufactured in one single operation.

Further characteristics of the invention and advantageous thereof will be evident from the following detailed specification in which reference will be made to the accompanying drawings.

Figure 2:
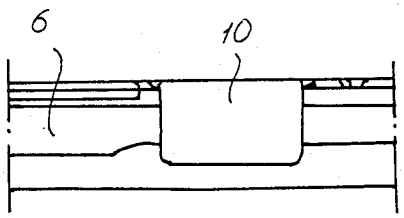
Figure 3:
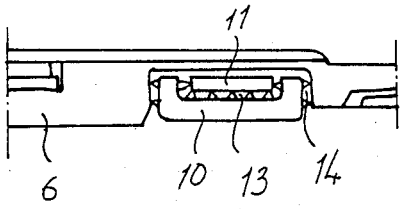
Figure 4:
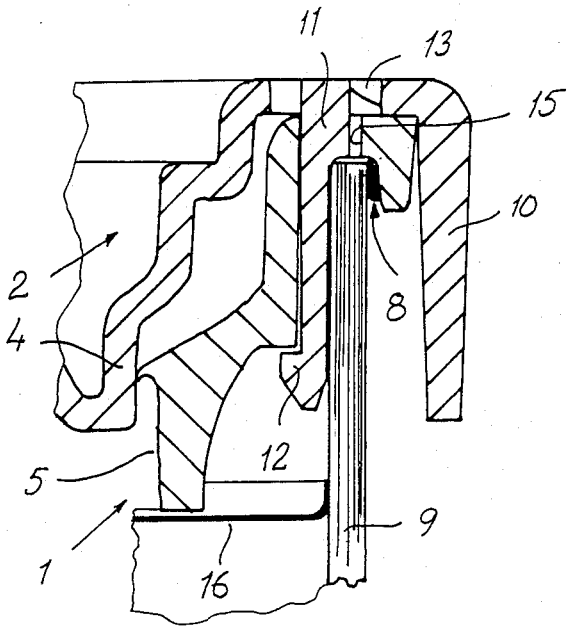
Figure 5:
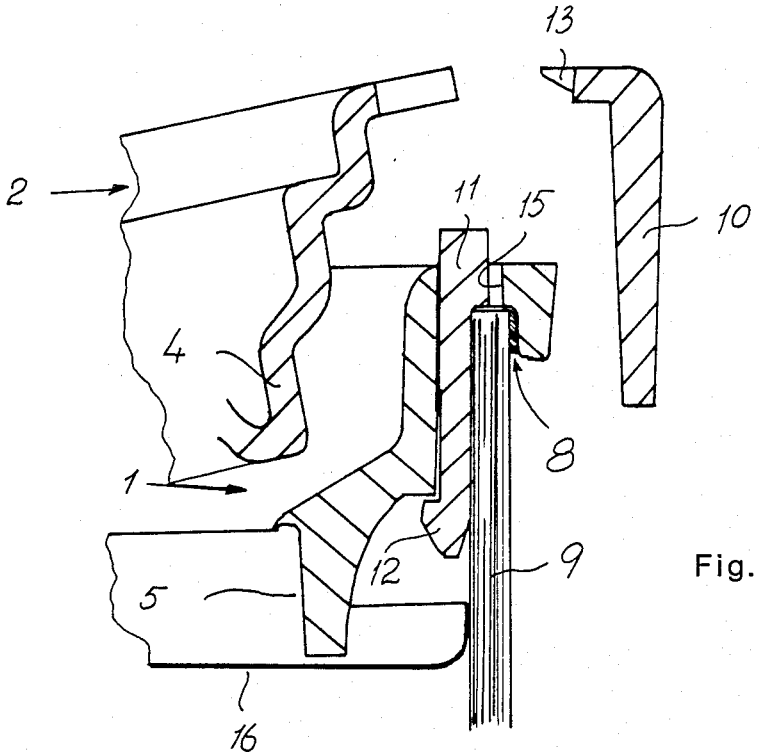

In the drawings FIG. 1 is an exploded perspective view of a container having a reclosable lid according to the invention and shown with the lid open. FIG. 2 is a front view of a detail of the reclosable lid according to the invention shown with the lid connected to the frame, and FIG. 3 is a top view of the same detail. FIG. 4 is a vertical cross section through the tamper proof means in a container having a reclosable lid according to the invention, and FIG. 5 shows, in a similar view, the container after the tamper proof means has been broken and the lid is opened.

The reclosable lid shown in FIG. 1 generally comprises a lid frame 1 and a lid panel 2 which is hinge connected to the lid frame over hinges 3, so that the lid panel can be rotated between a fully opened position substantially on level with the lid frame 1 and a closed position in which the lid panel is connected to the lid frame under at least powder proof or preferably steam proof conditions in that a downwardly projecting neck 4 of the lid panel is pressed down in a sealed opening 5 of the lid frame. As usual the lid frame is formed with a thumb grip 6 at the upper edge thereof for facilitating the opening of the container. The thumb grip 6 may have a snap lock hook 7 for engaging a corresponding recess (not shown) of the lid frame 1 for holding the lid panel in an easily releasable position relative to the frame.

As is conventional the lid frame 1 is formed with a downwardly facing channel 8 in which the upper edge of a tube blank 9 is adapted to be introduced and be secured by glueing, welding or any similar operation. The frame 1 thereby is sealingly connectd to the tube blank 9.

At any place along the lid panel, for instance adjacent the thumb grip 6, there is a tamper proof means comprising a tear off tongue 10, a securing pin 11 having a barb 12, several studs 13 which connect the tear off tongue 10 to the securing pin 11, and several studs 14 which connect the tear off tongue to the lid panel 2 so that tear off tongue can easily be torn off. The tear off tongue 10 with the securing pin 11 and the stubs 13 and 14 can be made integral in a common piece of material with the remaining parts of the reclosable lid.

The securing pin 11 extends down from the lid panel 2 and is formed for cooperation with a through bore 15 at the upper edge of the frame. The bore is larger in the direction opposing the centre of the container than the thickness of the securing pin and it is at least as large as the width of the securing pin at the barb 12 so that the securing pin can be introduced through the bore 15. The pin 11 is placed so as to engage the inner edge of the bore 15 with the inwardly facing side of the pin 11, and the barb engages under an edge 16 at the bottom side of the frame. The pin is resilient so that when the lid panel is closed for the first time the pin 11 will be introduced through the frame bore 15 and the barb 12 thereof will snap into engagement under the frame edge, whereby the frame and the lid become mutually interlocked.

The channel 8 is formed with such width that the combined width of the material of the tube blank 9 and the securing pin 11 corresponds to the width of the channel 8. The result is that the pin 11 can not be moved or extracted from the bore 15 after the tube blank is introduced into and secured in the channel 8.

As best shown in FIG. 3 the upper end of the tear tongue 10 is U-shaped and encloses the upper end of the securing pin 11, and in the illustrated case it keeps said pin by means of five studs 13. At the side of the U-shaped upper end the tear tongue it is secured in a recess of the lid panel by means of two studs 14 on each side.

When manufacturing the reclosable lid the frame, the lid panel, the tear tongue and the securing pin are pressed in an integral even piece of material and it can be delivered to the packer in this state. When time has come to mount the reclosable lid on the container blank the lid part thereof is folded down and is secured to the frame by means of the barb 12 of the securing pin 11 and the frame is mounted on top of the container blank and is secured thereto by means of glue, a weld joint or a similar means. The container tube blank may already have been closed at this end by means of a sealing foil 16.

The tear tongue 10 with the securing pin 11 provides a tamper proof means acting so that the lid 2 can not be folded up from the frame 1 without breaking the tear tongue and such breaking of the tear tongue is immediately visible. When the container is opened for the first time the tear tongue is bent upwards, whereby both the studs 13 and the studs 14 are broken and the lid is free to be opened. As usual the thumb grip is pressed upwards to release the lid panel. When reclosing the lid the snap lock hook 7 holds the lid in closed position for easy opening.

It is obvious that the reclosable lid can be formed with two or more tamper proof means at any chosen places of the container, and that many other modifications and variations may be presented within the scope of the appended claims.

What is claimed is:

1. Reclosable lid having a frame (1) adapted to be sealingly secured to the upper part of a container sleeve (9) and having a bore (15) therethrough and a downwardly facing channel (8) for receiving the upper part of the sleeve (9) therein, a securing lid (2), hinge means (3) for connecting the securing lid (2) to the frame (1) to move between open and close portions relative to the frame (1), and tamper proof means cooperating between the sealing lid (2) and the frame (1) for locking the sealing lid (2) in its closed position and including at least one securing pin (11) carried by the sealing lid (2), the one securing pin (11) having a leg and barb (12) projecting inwardly from the leg, and breakable connecting means (13, 14) for connecting the one securing pin (11) to the sealing lid (2), the bore (15) being of such size that the barb (12) can move through it, the barb (12) in the closed position of the sealing lid (2) engaging an edge of the frame (1) to retain the sealing lid (2) in its closed position, and characterized in that the bore (15) opens into the channel (8), the securing pin (11) is located in relation to the bore so that the leg portion thereof engages an outwardly facing portion of the bore (15), the width of the channel (8) in the region of the tamper proof mean being such that said upper part of said container sleeve (9) cooperates in assembly with said reclosable lid to prevent movement of said leg portion outwardly and in a direction away from the sealing lid (2) to release the barb (12) from locking engagement with the frame edge, whereby the securing pin is constantly secured in locking engagement with the frame and the breakable connecting means 13, 14 must be broken to release the sealing lid (2) for hinged movement from its closed to its open position leaving the securing pin (11) in the frame (1).

2. Reclosable lid as set forth in claim 1 further characterized by said breakable connecting means comprising a tear tongue connected to said securing pin (11) so that it can be torn off said securing pin and connected to said sealing lid (2) so that it can be torn off said sealing lid whereby the sealing lid (2) is released so that it can be hingedly moved from its closed position to an open position only when the tear tongue (10) is torn off the securing pin (11) and the sealing lid (2).

3. Reclosable lid as set forth in claim 2 further characterized in that said breakable connecting means comprises studs (13) between said securing pin (11) and said tear tongue (10) and studs (14) between said tear tongue (10) and said sealing lid (2) which are broken when said tear tongue (10) is bent upwards relative to said sealing lid and said frame.

* * * * *